US007229247B2

(12) United States Patent
Durocher et al.

(10) Patent No.: US 7,229,247 B2
(45) Date of Patent: Jun. 12, 2007

(54) DUCT WITH INTEGRATED BAFFLE

(75) Inventors: Eric Durocher, Vercheres (CA); Martin Jutras, St. Amable (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 46 days.

(21) Appl. No.: 10/927,117

(22) Filed: Aug. 27, 2004

(65) Prior Publication Data

US 2006/0045732 A1 Mar. 2, 2006

(51) Int. Cl.
*F01D 9/06* (2006.01)

(52) U.S. Cl. ..... 415/174.2

(58) Field of Classification Search ..... 415/110, 415/115, 135, 174.2, 174.5, 213.1, 215.1
See application file for complete search history.

(56) References Cited

U.S. PATENT DOCUMENTS 2,445,661 A 7/1948 Constant et al.
2,591,399 A * 4/1952 Howard et al. ..... 60/796
2,955,800 A 10/1960 Miller et al.
3,078,071 A * 2/1963 Willi et al. ..... 415/135
4,135,362 A * 1/1979 Glenn ..... 60/791
4,487,015 A 12/1984 Slattery et al.
4,747,750 A * 5/1988 Chlus et al. ..... 415/173.7
5,211,541 A 5/1993 Fledderjohn et al.
5,215,440 A 6/1993 Narayana et al.
5,333,443 A 8/1994 Halila
5,472,313 A * 12/1995 Quinones et al. ..... 415/115
5,545,004 A * 8/1996 Ho et al. ..... 415/115
6,109,022 A 8/2000 Allen et al.
6,131,384 A 10/2000 Ebel
6,286,303 B1 * 9/2001 Pfligler et al. ..... 60/805
6,447,252 B1 9/2002 Barker et al.

* cited by examiner

*Primary Examiner*—Edward K. Look
*Assistant Examiner*—Nathan Wiehe
(74) *Attorney, Agent, or Firm*—Ogilvy Renault LLP

(57) ABSTRACT

An integrated duct and baffle arrangement employing a hairpin transition area such that the construction is adapted to flex under thermal conditions.

20 Claims, 2 Drawing Sheets

DUCT WITH INTEGRATED BAFFLE

TECHNICAL FIELD

The invention relates generally to gas turbine engines and, more particularly, to a new duct and baffle construction.

BACKGROUND OF THE ART

Interturbine ducts (ITD) are used for channelling hot combustion gases from a high pressure turbine stage to a low pressure turbine stage. The ITD is typically integrally cast with the stator vane set of the low pressure turbine stage. Lug and slot arrangements are typically used to connect the inner annular wall of the cast ITD to an inner baffle protecting the rear facing side of the high pressure turbine rotor. Such a lug and slot arrangement has been heretofore required to accommodate the thermal gradient between the cast ITD inner wall and the baffle.

Although the conventional lug and slot arrangement is efficient, it has been found that there is a need to provide a new and simpler ITD/baffle interface.

SUMMARY OF THE INVENTION

It is therefore an aim of the present invention to provide a new gas turbine engine duct and baffle arrangement.

In one aspect, the present invention provides an interturbine duct (ITD) adapted to direct hot combustion gases from a high pressure turbine stage to a low pressure turbine stage of a gas turbine engine, the ITD comprising inner and outer flow path containing walls adapted to contain the combustion gases therebetween, a high pressure turbine baffle integrated to the inner flow path containing wall, and a flexible hairpin transition area providing for relative flexural movement between the high pressure turbine baffle and the inner wall under thermal conditions.

In a second aspect, the present invention provides a gas turbine engine duct and baffle arrangement comprising a duct for channelling hot combustion gases, and a baffle integrally connected to the duct via a flexible hairpin transition area.

In a third aspect, the present invention provides a turbine section of a gas turbine engine, comprising high and low pressure turbine stages, an interturbine duct (ITD) channelling hot combustion gases from the high pressure turbine stage to the low pressure turbine stage, a high pressure turbine baffle integrated to a front end portion of the ITD duct via a flex joint.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
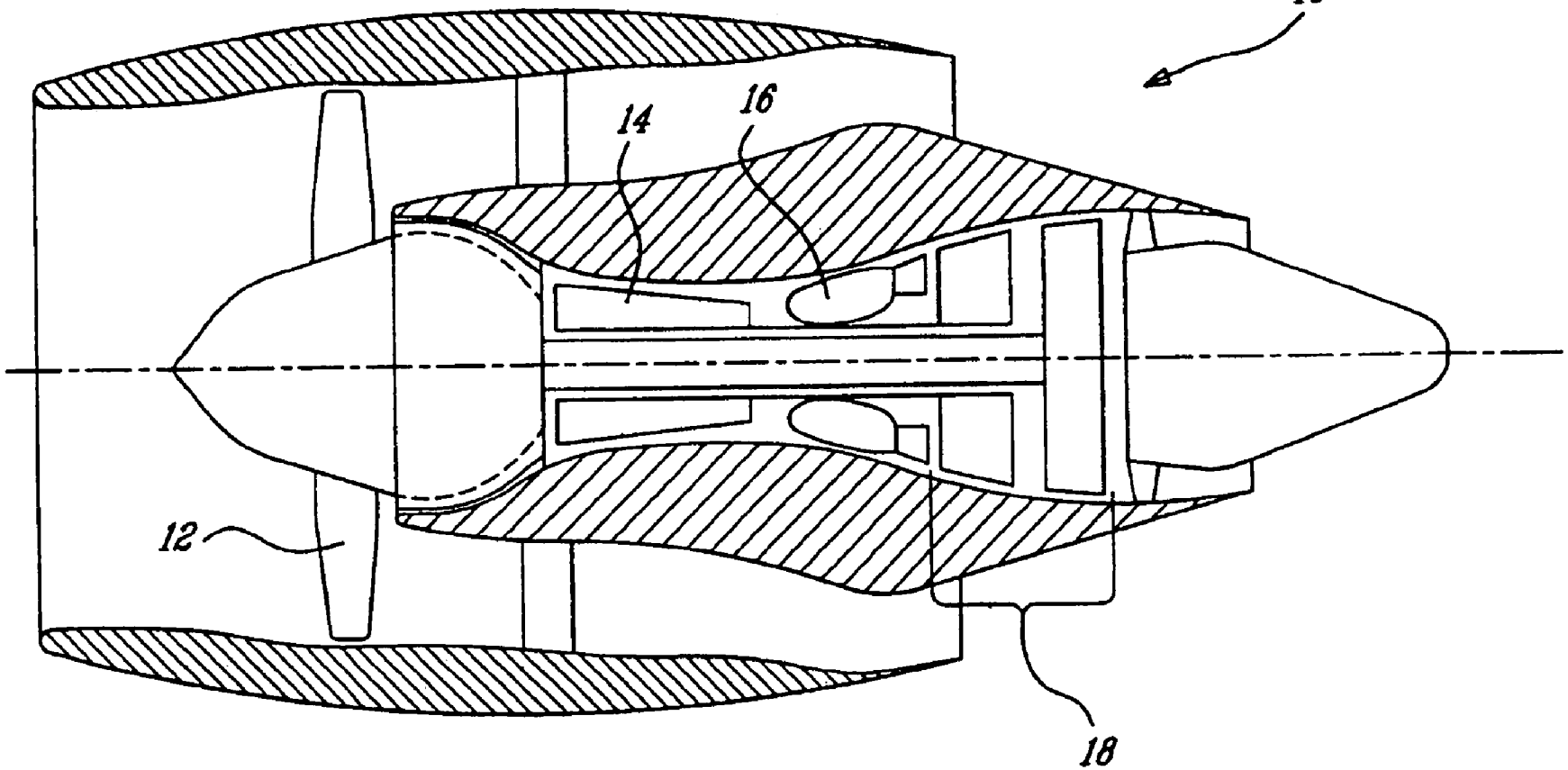
FIG. 1 is a cross-sectional side view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
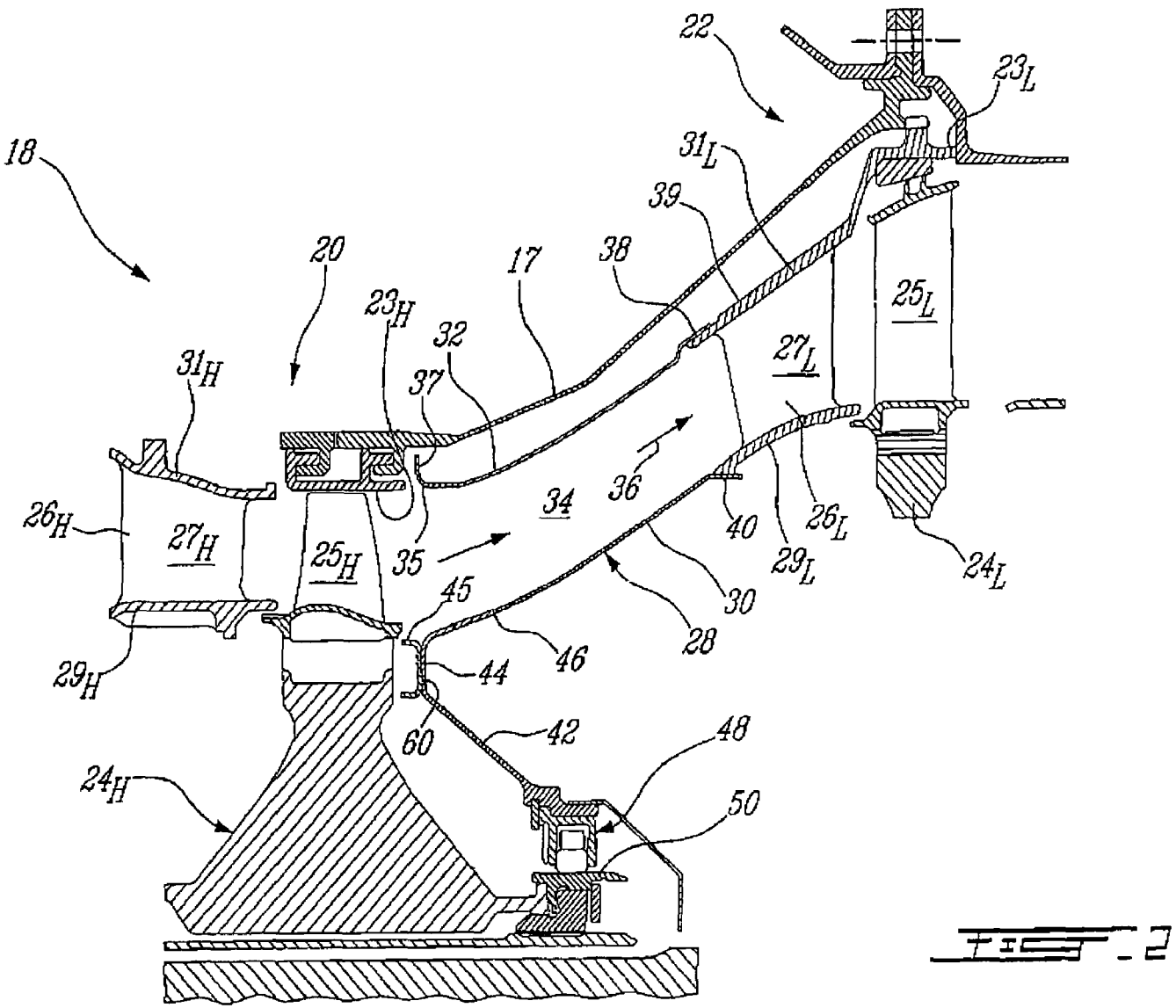
FIG. 2 is a cross-sectional side view of an interturbine duct with an integrated baffle forming part of the gas turbine engine shown in FIG. 1 in accordance with an embodiment of the present invention.

As shown in FIG. 2, the turbine section 18 comprises a turbine casing 17 containing at least first and second turbine stages 20 and 22, also referred to as high pressure turbine (HPT) and low pressure turbine (LPT) stages, respectively. Each turbine stage commonly comprises a shroud $\mathbf{23}_H$, $\mathbf{23}_L$, a turbine rotor $\mathbf{24}_H$, $\mathbf{24}_L$ that rotates about a centerline axis of the engine 10, a plurality of turbine blades $\mathbf{25}_H$, $\mathbf{25}_L$ extending from the rotor, and a stator vane ring $\mathbf{26}_H$, $\mathbf{26}_L$ for directing the combustion gases to the rotor. The stator vane rings $\mathbf{26}_H$, $\mathbf{26}_L$ typically comprises a series of circumferentially spaced-apart vanes $\mathbf{27}_H$, $\mathbf{27}_L$ extending radially between inner and outer annular platforms or shrouds $\mathbf{29}_H$, $\mathbf{29}_L$ and $\mathbf{31}_H$, $\mathbf{31}_L$, respectively. The platforms 29, 31 and the vanes 27 are typically made from high-temperature resistant alloys and preferably integrally formed, such as by casting or forging, together as a one-piece component.

An interturbine duct (ITD) 28 extends between the turbine blade $\mathbf{25}_H$ of the first turbine stage 20 and the stator vane ring $\mathbf{26}_L$ of the second turbine stage 22 for channelling the combustion gases from the first turbine stage 20 to the second turbine stage 22. As opposed to conventional interturbine ducts which are integrally cast/machined with the stationary vane ring $\mathbf{26}_L$ of the second turbine stage 22 (see U.S. Pat. No. 5,485,717, for example), the ITD 28 is preferably fabricated from sheet material, such as sheet metal, and brazed, welded or otherwise attached to the turbine vane ring $\mathbf{26}_L$. The sheet metal ITD 28 is advantageously much thinner than cast ducts and therefore much more lightweight. The person skilled in the art will appreciate that the use of sheet metal or other thin sheet material to fabricate an interturbine duct is not an obvious design choice due to the high temperatures and pressures to which interturbine ducts are exposed, and also due to the dynamic forces to which the ITD is exposed during operation. Provision for such realities is therefore desired, as will now be described.

The ITD 28 comprises concentric inner and outer annular walls 30 and 32 defining an annular flowpath 34 which is directly exposed to the hot combustion gases that flows theretrough in the direction indicated by arrow 36. The inner and outer annular walls 30 and 32 are preferably a single wall of a thin-walled construction (e.g. sheet metal) and preferably have substantially the same wall thickness. According to an embodiment of the present invention, the inner and outer annular walls 30 and 32 are each fabricated from a thin sheet of metal (e.g. an Inconel alloy) rolled into a duct-like member. It is understood that ITD 28 could also be fabricated of other thin sheet materials adapted to withstand high temperatures. Fabricating the ITD in this manner gives much flexibility in design, and permits the ITD 28 to be integrated with the engine case 17 if desired. The annular walls 30, 32 extend continusously smoothly between their respective ends, without kinks, etc, and thus provide a simple, smooth and lightweight duct surface for conducting combustion gases between turbine stages.

The outer annular wall 32 extends from an upstream edge 35, having annular flange 37 adjacent HPT shroud $\mathbf{23}_H$, the flange extending radially away (relative to the engine axis) from ITD 28, to a downstream end flange 38, the flange having an S-bend back to accommodated platform $\mathbf{31}_L$ smoothly, to minimize flow disruptions in path 34. The annular end flange portion 38 is preferably brazed to the radially outward-facing surface 39 of the outer platform $\mathbf{31}_L$. The outer annular wall 32 is not supported at its upstream end (i.e. at flange 37) and, thus, it is cantilevered from the stator vane set 26 of the second turbine stage 22. The flange 37 is configured and disposed such that it impedes the escape of hot gas from the primary gas path 34 to the cavity surrounding ITD 28, which advantageously helps improve turbine blade tip clearance by assisting in keeping casing 17 and other components as cool as possible. Meanwhile, the cantilevered design of the leading edge 35 permits the leading edge to remain free of and unattached from the turbine support case 17, thereby avoiding interference and/or deformation associated with mismatched thermal expansions of these two parts, which beneficially improves the life of the ITD. The flange 37, therefore, also plays an important strengthening role to permit the cantilevered design to work in a sheet metal configuration.

The inner annular wall 30 is mounted to the stator vane set 26 of the second turbine stage 22 separately from the outer annular wall 32. The inner annular wall 30 has a downstream end flange 40, which is preferably cylindrical to thereby facilitate brazing of the flange to a front radially inwardly facing surface of the inner platform $\mathbf{29}_L$ of the stator vane set $\mathbf{26}_L$ of the second turbine set 22. The provision of the cylindrical flange 40 permits easy manufacture within tight tolerances (cyclinders can generally be more accurately formed (i.e. within tighter tolerances) than other flange shapes), which thereby facilitates a high quality braze joint with the vane platform.

The inner annular wall 30 is integrated at a front end thereof with a baffle 42 just rearward of the rotor $\mathbf{24}_H$ of the first turbine stage 20. The baffle 42 provides flow restriction to protect the rear face of the rotor $\mathbf{24}_H$ from the hot combustion gases. The integration of the baffle 42 to the ITD inner annular wall 30 is preferably achieved through a "hairpin" or U-shaped transition which provides the required flexibility to accommodate thermal growth resulting from the high thermal gradient between the ITD inner wall 30 and the baffle 42.

The upstream end portion of the inner annular wall 30 is preferably bent outward at a first 90 degrees bend to provide a radially inwardly extending annular web portion 44, the radial inner end portion of which is bent slightly axially rearward to merge into the inclined annular baffle 42. A forward-facing C-seal 45 is provided forwardly facing on web 44, to provide the double function of impeding the escape of hot gas from the primary gas path 34 and to strengthen and stiffen web 44 against dynamic forces, etc. The inner annular wall 30, the web 44 and the baffle 42 form a one-piece hairpin-shaped member with first and second flexibly interconnected diverging segments (i.e. the ITD inner annular wall 30 and the baffle 42). In operation, the angle defined between the ITD inner annular wall 30 and the baffle 42 will open and close as a function of the thermal gradient therebetween. There is no need for any traditional lug-and-slot arrangement to accept the thermal gradient between the baffle 42 and the ITD inner wall 30. The hairpin configuration is cheaper than the traditional lug and slot arrangement because it does not necessitate any machining and assembly. The baffle 42 is integral to the ITD 28 while still allowing relative movement to occur therebetween during gas turbine engine operation. Since ITD 28 is provided as a single sheet of metal, sufficient cooling must be provided to ensure the ITD has a satisfactory life. For this reason, a plurality of cooling holes 60 is provided in web 44 for appropriate communication with an upstream secondary air source (not shown). Cooling holes 60 are adapted to feed secondary air, which would typically be received from a compressor bleed source (not shown) and perhaps passed to holes 60 via an HPT secondary cooling feed system (not shown) therethrough, and directed initially along inner duct 30 for cooling thereof. This cooling helps the single-skin sheet metal ITD to have an acceptable operational life. The U-shaped bent portion of the hairpin-shaped member is subject to higher stress than the rectilinear portion of ITD inner wall 30 and is thus preferably made of thicker sheet material. The first and second sheets are preferably welded together at 46. However, it is understood that the hairpin-shaped member could be made from a single sheet of material.

The baffle 42 carries at a radial inner end thereof a carbon seal 48 which cooperate with a corresponding sealing member 50 mounted to the rotor 24. The carbon seal 48 and the sealing member 50 provide a stator/rotor sealing interface. Using the baffle 42 as a support for the carbon seal is advantageous in that it simplifies the assembly and reduces the number of parts.

The above description is meant to be exemplary only, and one skilled in the art will recognize that changes may be made to the embodiments described without department from the scope of the invention disclosed. For example, the ITD 28 could be supported in various ways within the engine casing 17. Also, if the stator vane set 27 is segmented, the inner and outer sheet wall of the ITD 28 could be circumferentially segmented. It is also understood that various flex joint or elbows could be used at the transition between the ITD inner wall 30 and the baffle 42. Finally, it is understood that the above-described integrated duct and baffle arrangement could have other applications. Still other modifications which fall within the scope of the present invention will be apparent to those skilled in the art, in light of a review of this disclosure, and such modifications are intended to fall within the appended claims.

The invention claimed is:

1. An interturbine duct (ITD) adapted to direct hot combustion gases from a high pressure turbine stage to a low pressure turbine stage of a gas turbine engine, the ITD comprising inner and outer flow path containing walls adapted to contain the combustion gases therebetween, the inner and outer flow path containing walls being made of sheet metal and cantilevered from the low pressure turbine stage, a high pressure turbine baffle integrated to the inner flow path containing wall, and a flexible hairpin transition area providing for relative flexural movement between the high pressure turbine baffle and the inner wall under thermal conditions, the high pressure turbine baffle having an unattached, free radially inner end which is movable relative to the inner flow path.

2. The ITD as defined in claim 1, wherein both said high pressure turbine baffle and said inner flow path containing wall are Made from sheet material.

3. The ITD as defined in claim 2, wherein said high pressure turbine baffle and said inner flow path containing wall are made from a saMe sheet of material.

4. The ITD as defined in claim 2, wherein said hairpin transition area and said high pressure turbine baffle are made of a first sheet of material, said inner flow path containing wall being at least partly made from a second sheet of material, said second sheet of material being integrally connected to said first sheet of material.

5. The ITD as defined in claim 4, wherein said second sheet of material is thinner than said first sheet of material.

6. The ITD as defined in claim 1, wherein said hairpin transition area includes a curved section between the inner flow path containing wall and the high pressure turbine baffle, and wherein said high pressure turbine baffle is spaced radially inwardly from said inner flow path containing wall.

7. The ITD as defined in claim 6, wherein said inner flow path containing wall and the high pressure turbine baffle are annular.

8. The ITD as defined in claim 1, wherein said high pressure turbine baffle carries a carbon seal.

9. A gas turbine engine duct and baffle arrangement comprising a duct for channelling hot combustion gases, and a baffle integrally connected to the duct via a flexible hairpin transition area, the baffle having a free distal end movable relative to the duct.

10. The arrangement as defined in claim 9, wherein the baffle is spaced-radially inwardly from an outer surface of the duct.

11. The arrangement as defined in claim 9, wherein the duct and the baffle are fabricated from sheet metal.

12. The arrangement as defined in claim 9, wherein the duct includes inner and outer annular walls defining the flow path boundaries of the hot combustion gases, the baffle and the hairpin transition area being integral to the inner annular wall of the duct.

13. The arrangement as defined in claim 12, wherein the baffle and the hairpin transition area are made from a same sheet of material.

14. The arrangement as defined in claim 12, wherein said hairpin transition area and said baffle are made of a first sheet of material, said inner wall being at least partly made from a second sheet of material, said second sheet of material being thinner than said first sheet of material.

15. The arrangement as defined in claim 9, wherein said high pressure turbine baffle carries a carbon seal.

16. A turbine section of a gas turbine engine, comprising high and low pressure turbine stages, an interturbine duct (ITD) channelling hot combustion gases from the high pressure turbine stage to the low pressure turbine stage, a high pressure turbine baffle integrated to a front end portion of the ITD duct via a flex joint having a hairpin shape configuration, the high pressure turbine baffle having a free distal end movable relative to the ITD duct.

17. The turbine section as defined in claim 16, wherein the flex joint and the baffle are of unitary construction.

18. The turbine section as defined in claim 16, wherein the flex joint defines a rearwardly open mouth between the front end portion of the ITD duct and the high pressure turbine baffle.

19. The turbine section as defined in claim 16, wherein the ITD, the flex joint and the baffle are integrally made from sheet metal.

20. The turbine section as defined in claim 16, further comprising a forward-facing C-shaped member mounted to the flex joint.

* * * * *